United States Patent [19]

Trout et al.

[11] 3,948,408

[45] Apr. 6, 1976

[54] PUMP STATION STRUCTURE

[75] Inventors: Dennis C. Trout; William P. Hazen, both of Overland Park, Kans.

[73] Assignee: Ecodyne Corporation, Lincolnshire, Ill.

[22] Filed: Jan. 9, 1975

[21] Appl. No.: 539,659

Related U.S. Application Data

[63] Continuation of Ser. No. 347,272, April 2, 1973, abandoned.

[52] U.S. Cl. ..... 220/5 A; 220/1 B; 220/71

[51] Int. Cl.[2] ..... B65D 7/02

[58] Field of Search ..... 220/5 A, 5 R, 18, 71, 72, 220/1 B

[56] References Cited

UNITED STATES PATENTS

| | | | |
|---|---|---|---|
| 1,983,355 | 12/1934 | Escher | 220/1 B X |
| 2,477,831 | 8/1949 | Schmitz, Jr. | 220/1 B |
| 3,409,916 | 11/1968 | Billig et al. | 220/1 B X |
| 3,448,885 | 6/1969 | Parks | 220/5 |

*Primary Examiner*—William Price
*Assistant Examiner*—Steven M. Pollard
*Attorney, Agent, or Firm*—Joel E. Siegel

[57] ABSTRACT

A horizontally elongated container for an underground equipment installation which includes a flat floor and ceiling along with semi-cylindrical end shells. The container is reinforced by rigid-frame beam rings around a flat-sided center section.

4 Claims, 2 Drawing Figures

Fig. 1.
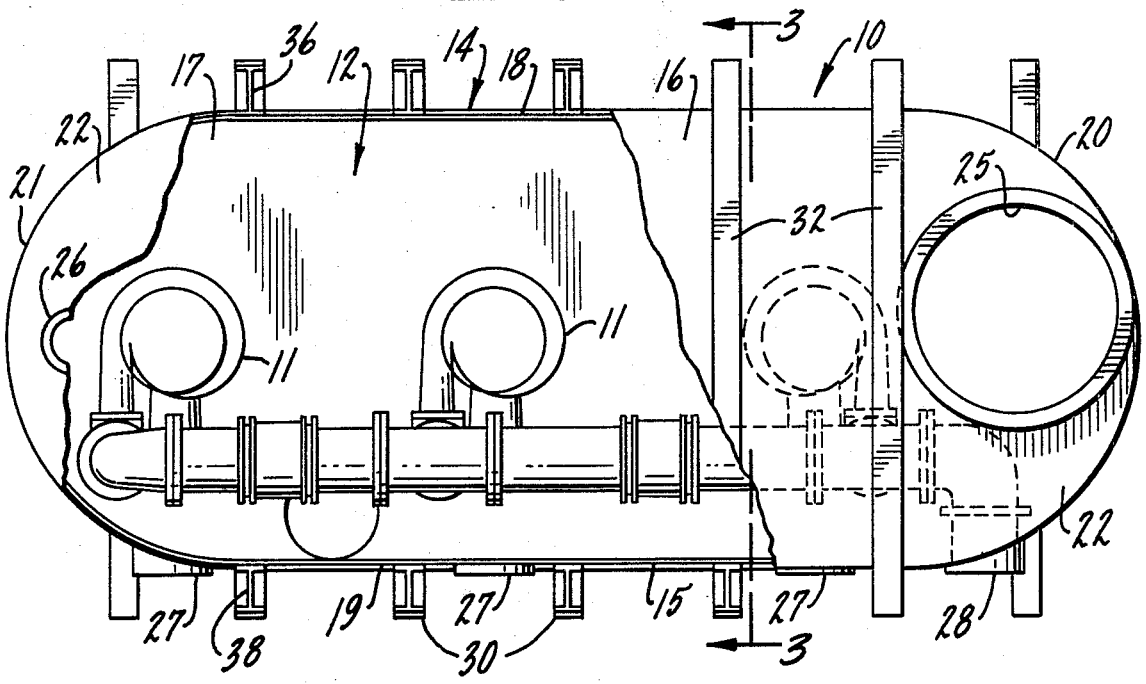
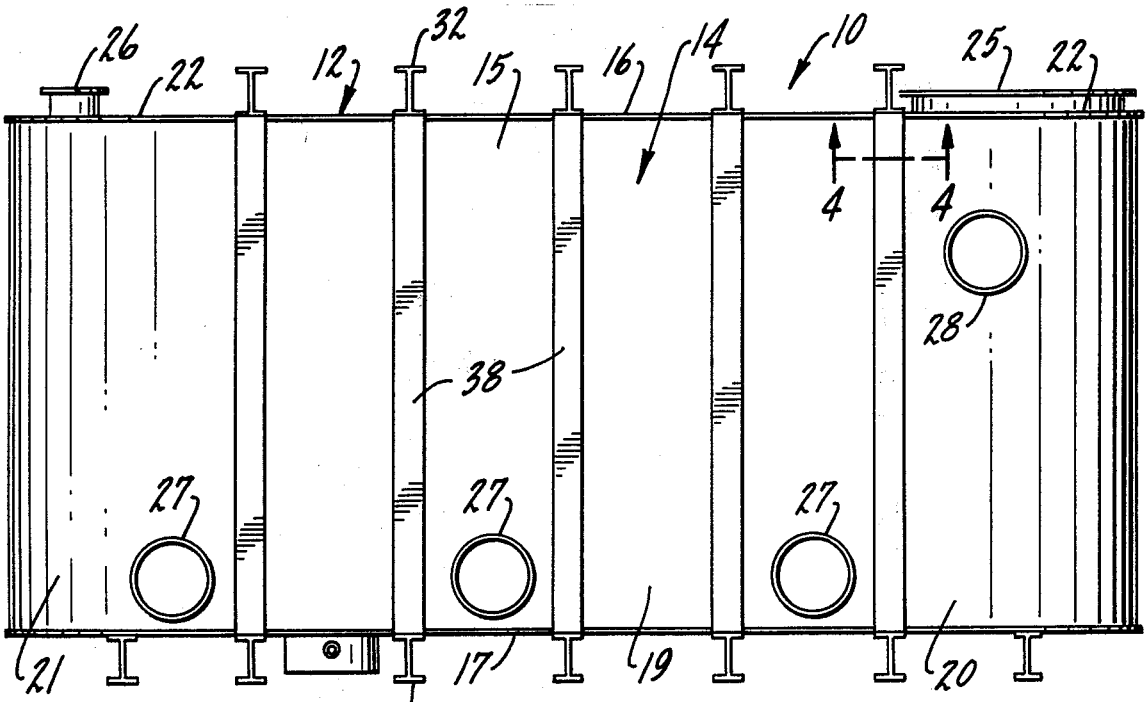
Fig. 2.

PUMP STATION STRUCTURE

This is a continuation of application Ser. No. 347,272, filed Apr. 2, 1973, now abandoned.

BACKGROUND AND SUMMARY OF THE INVENTION

This invention relates in general to large containers. It deals particularly with large containers especially adapted for use in an underground environment.

In a self-contained sewage treatment system, for example, it is conventional to house the pumping equipment for the system in an underground container. Normally this equipment includes a plurality of pumps arranged side-by-side, in an elongated series. The protective container must necessarily have a generally horizontal, elongated configuration to house the equipment, as will readily be understood.

The simplest form a horizontally elongated container can take is, of course, a rectangular box-like structure having flat side, end, top, and bottom walls. Where the container is buried underground, however, the external pressure caused by the weight of the earth and effective on the flat walls necessitates substantially reinforcing the walls to prevent their collapse under stress. This is particularly true in a hollow container containing no liquid sewage or the like to counteract external pressures. The heavy reinforcement required in such a container necessarily increases the cost of the container substantially.

Elliptical containers have heretofore been used to house pumping equipment, but in order to properly utilize the available floor space in these types of containers, it has been necessary to provide additional internal piping in order to gain even reasonable utilization of the floor space available. Additionally, elliptical containers are severely restricted in practical length due to the fact that since the maximum width must be limited to approximately 12 feet to facilitate shipment, it is necessary to increase the shell plate thickness if the length of the container is to be increased.

The cellular container disclosed in U.S. Pat. No. 3,448,885 to J. W. Parks, and assigned to the same assignee of the present invention, increases the utilization of available floor space as compared to that of the elliptical container. However, this design requires a large shell plate thickness and increases the cost of fabrication due to the precision required in construction.

The object of the present invention is to provide a container structure for housing pumping equipment or the like underground which efficiently encloses space to form an essentially rectangular floor plan and wherein the container side walls are able to withstand relatively high compressive loads from the surrounding earth without excessive shell plate thickness or extensive reinforcing structures. The foregoing and other objects of the invention are realized in a container which includes a flat floor and ceiling, vertical side walls, and a semi-cylindrical end shell. The structure is reinforced sufficiently to avoid detrimental deflection primarily by rigid-frame beam rings around the flat-sided center section.

More precisely, a plurality of steel plates are fabricated to a rectangular center structure having a pair of substantially vertical side walls, a floor, and a ceiling. A semi-cylindrical end shell formed from steel plate is welded to the edges of the side walls closing off each end of the rectangular center structure. Rigid-frame beam rings around the flat-sided center section reinforce the structure. The rings comprise a pair of side ring members disposed on each side of the container which are welded to the ends of a ceiling ring member and a floor ring member to form a rectangular reinforcing ring around the rectangular center section. Corner stiffeners extend between the reinforcing rings at the top corners to prevent detrimental plate deflection between the rings due to stress. The cylindrical end shell segments may be of reduced thickness due to an inherent characteristic of the specific shell shape. Additionally, the reinforcing ring members may be sized as "fixed-end" members owing to the fact that the center structure is substantially restrained by the reinforcing rings. The hereinabove mentioned prior art structures are constructed primarily of "simple-supported" members which possess one and one-half times the moment of fixed-end members for the same uniformly distributed loading, which is the type of loading exerted on most underground pump station structures.

BRIEF DESCRIPTION OF THE DRAWINGS

Other objects and features of the invention will become apparent to those skilled in the art as the disclosure is made in the following description of a preferred embodiment of the invention, as illustrated in the accompanying sheets of drawings, in which:

FIG. 1 is a top plan view of the container structure constructed in accordance with the present invention, with the container top partially broken away to show the exemplary pumping equipment housed therein;

FIG. 2 is an elevational view of the container structure illustrated in FIG. 1;

DESCRIPTION OF A PREFERRED EMBODIMENT

Figure 3:
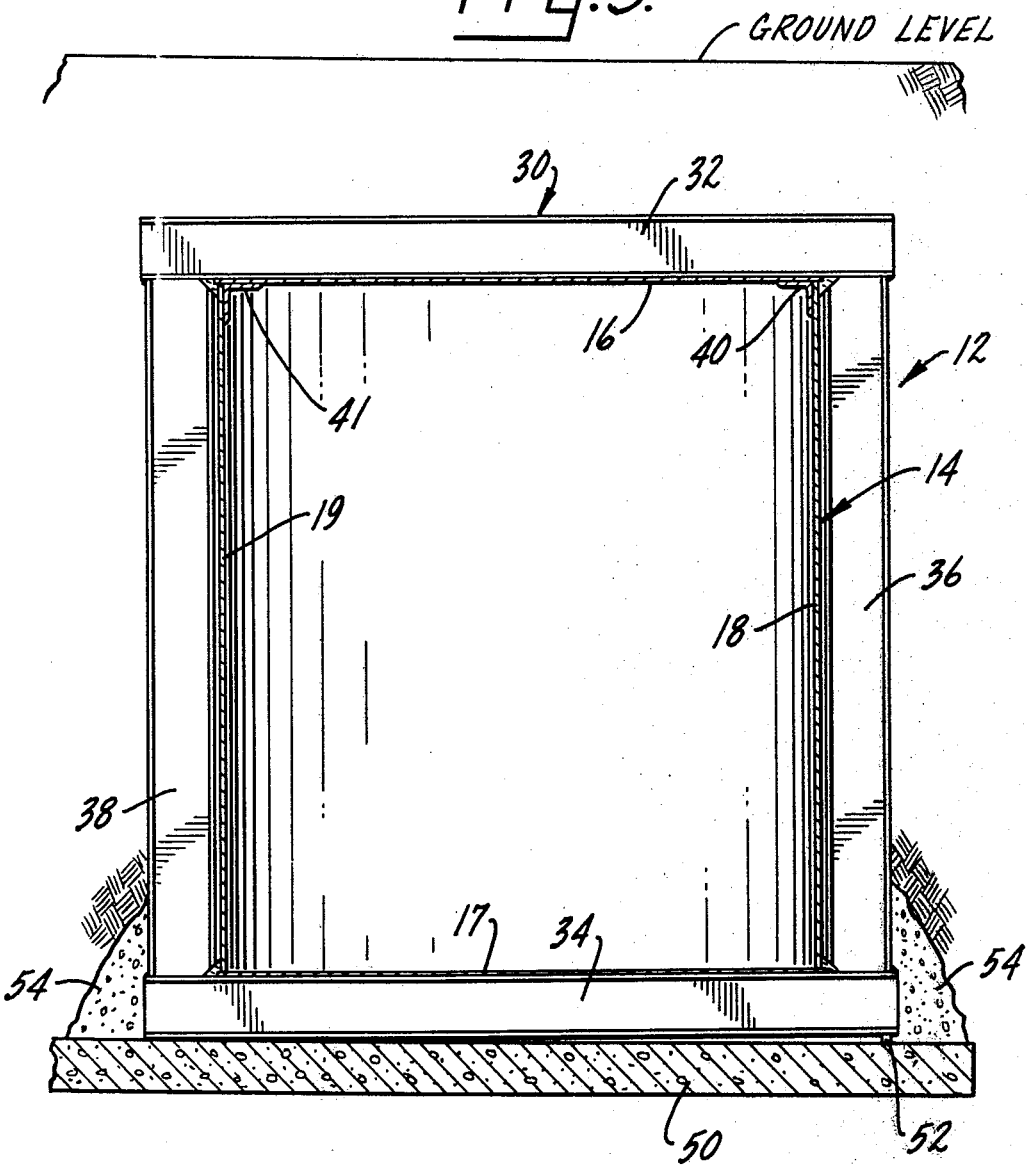
FIG. 3 is a sectional view taken along line 3—3 in FIG. 1 of the container structure in its underground location.

Referring now to the drawings, and particularly to FIGS. 1 and 2, an underground pumping station for sewage or the like is seen generally at 10. The pumping station 10, which is buried several feet under the soil, includes a plurality of pumps 11 arranged in a longitudinally elongated series within a container 12 constructed in accordance with the present invention.

Figure 4:
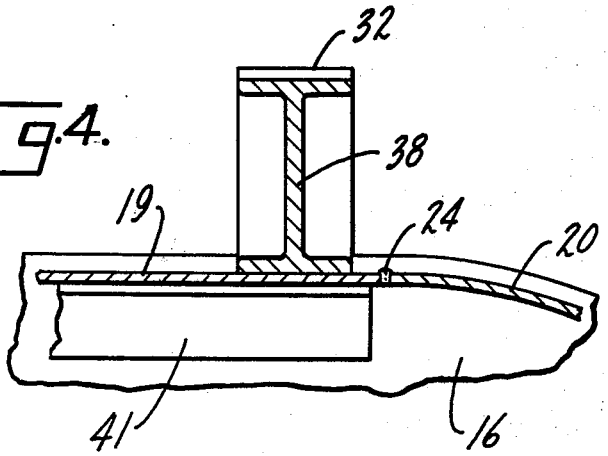
FIG. 4 is a sectional view taken along line 4—4 in FIG. 2 showing the joint between the side walls and the end segments.

The container 12 includes a shell 14 defined by a top wall 16, a bottom wall 17, a pair of side walls 18 and 19, and a pair of end walls 20 and 21; all fabricated of steel sheet. The top wall 16 and bottom wall 17 have conventionally flat configurations, and are of substantially rectangular shape with rounded end sections, indicated at 22 in FIG. 1. The side walls 18 and 19 are likewise of flat configuration and rectangular shape and extend between the straight sections of top wall 16 and bottom wall 17. The end walls 20 and 21 are fabricated of steel plate in the form of a semi-cylindrical shell; the upper and lower edges of which have substantially the same radius of curvature as end sections 22 and the vertical edges of which are spaced apart for attachment to the vertical edges of the side walls 18 and 19. Referring to FIG. 4, the vertical edges of end walls 20 and 21 are welded to the vertical edges of side walls 18 and 19, as indicated at 24. The top wall 16 and the bottom wall 17 are sized slightly larger than the periphery formed by the side walls 18 and 19 and the end walls 20 and 21 to facilitate their attachment thereto by welding.

Numerous openings are provided through the shell 14 to permit access thereinto for various fittings such as an entrance tube 25, an exhaust blower 26, suction pipes 27, and a discharge pipe 28.

The shell structure 14 is reinforced to avoid detrimental deflection by a plurality of rigid-frame beam rings 30 positioned around the flat-sided center section 15 of the shell 14 between the end walls 20 and 21. Referring to FIG. 3, each reinforcing ring 30 includes a ceiling ring member 32 positioned above top wall 16, a floor ring member 34 positioned below bottom wall 17, and a pair of side ring members 36 and 38 positioned respectively adjacent side walls 18 and 19. The members 32, 34, 36, and 38 are preferably of an I-beam construction and are in turn welded together to form the rigid-frame beam ring 30 having a rectangular cross section. Members 32 and 34 extend outward of the side walls 18 and 19 a sufficient distance to receive and support the members 36 and 38 therebetween and to permit the appropriate welds to be accomplished.

Corner stiffeners 40 and 41 are respectively provided at the corners formed at the intersection between the side walls 18 and 19 and the top wall 16, as seen in FIG. 3. Stiffeners 40 and 41 are preferably of steel angle iron construction and are welded along their edges to the respective side walls 18 and 19 and the top wall 16.

Referring to FIG. 3, the container 12 is supported on a concrete foundation 50 poured-in-place below the ground. Elevating blocks 52 are provided along one edge of the container 12 between the foundation 50 and the floor ring members 34 to slightly tilt container 12 for drainage purposes. Concrete grout 54 is provided to close off the space between the rings 30 at their bottom corners. The container is then back-filled with earth to bury it below the ground.

The rigid-frame rings 30 with their side ring members 36 and 38 are utilized to transfer the end loads carried by the ceiling and floor ring members 32 and 34 into the center section 15 of shell 14 without causing shell deformation. With the side ring members 36 and 38 placed between the ceiling and floor ring members 32 and 34, the end loads of these members are transferred into the side ring members as a compressive load. The same result occurs with the end loads of the side ring members 36 and 38 being transferred into the ceiling and floor ring members 32 and 34. The external loads imposed on the semi-cylindrical end walls 20 and 21 results in circumferential compressive stress in these ends which are transmitted into the flat side walls 18 and 19. The corner stiffeners 40 and 41 positioned between the reinforcing rings 30 prevent deflection between these rings due to this stress. The bottom corners are sufficiently reinforced due to the compressive strength of the grout 54 which is placed between the rings 30.

The capsular container structure constructed in accordance with the present invention lends itself to cost minimization on a material versus labor cost basis by providing the following variables, each dependent on the other: (1) the number of reinforcing rings; (2) the size of the reinforcing; and (3) the different plate thickness of the top wall, side walls, bottom wall, and the end walls. Particular attention should be given to the fact that the rounded end walls do not have to be as thick as the flat side walls due to the inherent characteristics of the particular shape. For example, the side walls may be fabricated from ⅜ inch steel plate, while the end walls are fabricated from ¼ inch steel plate.

It should be understood, of course, that the foregoing disclosure relates to only a preferred embodiment of the invention and that numerous modifications or alterations may be made therein without departing from the spirit and the scope of the invention as set forth in the appended claims.

What is claimed is:

1. A horizontally elongated container for housing sewage treatment equipment for an underground installation, comprising:

a. side walls of substantially rectangular shape;

b. a substantially horizontal ceiling supported above said side walls, said ceiling having a substantially rectangular center section extending the length of said side walls and a pair of rounded end sections extending longitudinally beyond said side walls;

c. a substantially horizontal floor positioned below said side walls, said floor having a substantially rectangular center section extending the length of said side walls and a pair of rounded end sections extending longitudinally beyond said side walls;

d. end walls of semi-cylindrical shape secured along their vertical edges to said side walls and along their horizontal edges to the rounded end sections of said ceiling and floor;

e. a plurality of rigid-frame beam rings extending around the flat-sided center portion of said container;

f. said rigid-frame beam rings include substantially vertical side ring members extending substantially the entire height of each of said side walls, a substantially horizontal floor ring member secured to the lower ends of said side ring members and a substantially horizontal ceiling ring member secured to the upper ends of said side ring members;

g. said ceiling ring member and said floor ring member extend respectively beyond the edges of said ceiling and said floor, and said side ring members are secured to the underside of said ceiling ring member and the topside of said floor ring member; and h. corner stiffener members secured between adjacent rigid-frame beam rings along the intersection between said ceiling and said side walls.

2. The invention as defined in claim 1 wherein said side ring members, said floor ring member, and said ceiling ring member are structural steel I-beams.

3. The invention as defined in claim 1 wherein the vertical edges of said end walls are welded to the vertical edges of said side walls.

4. The invention as defined in claim 1 wherein said corner stiffener members are angle irons whose edges are respectively welded to said ceiling and said side walls.

* * * * *